United States Patent [19]

Foelix et al.

[11] 4,148,377

[45] Apr. 10, 1979

[54] APPARATUS FOR ACTUATING HOISTWAY DOORS OF AN ELEVATOR

[75] Inventors: Heinz D. Foelix; Georg Lang, both of Schaffhausen, Switzerland

[73] Assignee: Inventio AG, Hergiswil NW, Switzerland

[21] Appl. No.: 864,090

[22] Filed: Dec. 23, 1977

[30] Foreign Application Priority Data

Jan. 10, 1977 [CH] Switzerland ..... 239/77

[51] Int. Cl.[2] ..... B66B 13/12

[52] U.S. Cl. ..... 187/52 LC; 49/118; 187/56

[58] Field of Search ..... 187/52 LC, 52 R, 51, 187/56, 62; 49/118; 403/321, 322

[56] References Cited

U.S. PATENT DOCUMENTS

| | | | |
|---|---|---|---|
| 740,569 | 10/1903 | Jenkins | 187/52 R |
| 1,876,438 | 9/1932 | Werner | 187/52 LC |
| 2,094,385 | 9/1937 | Vanderzee | 187/56 |
| 2,481,124 | 9/1949 | Kruger | 187/52 LC |

FOREIGN PATENT DOCUMENTS

| | | | |
|---|---|---|---|
| 765650 | 1/1957 | United Kingdom | 187/52 LC |

*Primary Examiner*—Robert B. Reeves
*Assistant Examiner*—Jeffrey V. Nase
*Attorney, Agent, or Firm*—Werner W. Kleeman

[57] ABSTRACT

An apparatus for actuating the hoistway doors of an elevator, which comprises a coupling element fixedly arranged at the hoistway or elevator shaft door and a movable electromagnetically actuatable coupling element arranged at the elevator cabin door which, at the region of an elevator landing or storey can be brought into engagement with the fixed coupling element of the hoistway door. The movable coupling element arranged at the elevator cabin door comprises an entrainment member composed of discs arranged at essentially the same spacing from one another. The stationary or fixed coupling element mounted at the hoistway door comprises a comb having prongs which possess an essentially uniform spacing from one another, which spacing is dimensioned such that the discs of the entrainment member, during the coupling action, engage with play between the prongs of the comb.

7 Claims, 2 Drawing Figures

APPARATUS FOR ACTUATING HOISTWAY DOORS OF AN ELEVATOR

BACKGROUND OF THE INVENTION

The present invention relates to a new and improved apparatus for actuating the hoistway or shaft doors of an elevator or the like, which is of the type comprising a fixed coupling element arranged at the hoistway or elevator shaft door and a movable, electromagnetically actuatable coupling element arranged at the elevator door, this movable coupling element, at the region of an elevator landing, can be brought into engagement with the fixed coupling element of the hoistway door.

Such type apparatuses have the purpose of continuously and synchronously opening and closing, respectively, horizontally displaceable elevator cabin and hoistway doors by means of a door drive mounted at the elevator cabin when the latter reaches a landing or storey.

Now in British Pat. No. 587,984 there is disclosed apparatus for simultaneously actuating the elevator cabin and hoistway doors of an elevator system, wherein an electromagnet arranged at the elevator cabin is actuated by a coupling element movably mounted at the elevator cabin door through the agency of a lever rod. The coupling element possesses a substantially wedge-shaped cross-sectional configuration and, when the electromagnet is energized, is retained in its uncoupled position. The fixed coupling element mounted at the hoistway door has a substantially V-shaped groove which is essentially complementary in shape to the wedge-shaped cross-section of the movable coupling element. When the elevator stops at a landing the electromagnet is deenergized and both of the coupling elements can come into engagement under the action of spring force.

Another prior art apparatus as taught in U.S. Pat. No. 1,876,438 has the electromagnet mounted directly over the movable coupling element in the cabin door and connected therewith by a hinge or pivot arrangement. The movable coupling element is retained in its uncoupled position under the force of gravity, whereas when the electromagnet is energized it comes into engagement with the fixed coupling element mounted at the hoistway door.

The previously described door actuation devices are especially associated with the drawback that both of the coupling elements must be situated exactly opposite one another during the coupling operation. In other words: no deviations can be present in the direction of the door movement between the coupling elements.

This drawback is avoided to a certain extent with the further state-of-the-art door drive apparatus disclosed in Swiss Pat. No. 523,199. With this apparatus the movable coupling element comprises an entrainment parallelogram arranged at the elevator cabin door and collapsed or pushed together in the uncoupled state thereof. This entrainment parallelogram is connected with a door drive arranged at the cabin by means of a sliding crank drive. The door drive is constructed as a thrust crank drive. Two rolls rotatably mounted upon pins or journals constitute the fixed coupling element and are provided at the elevator shaft or hoistway door. When the elevator cabin approaches a target landing, then the entrainment parallelogram is driven by the door drive which has started-up in the meantime so that upon introduction between both of the rolls the entrainment parallelogram is shifted from its collapsed into its spread position and bears at the rolls for the purpose of entraining the hoistway door free of play.

A disadvantage of this apparatus resides in that it is of relatively complicated construction. A further drawback is present by virtue of the fact that the door drive starts to run and the entrainment parallelogram spreads before the elevator cabin has reached the target landing or storey, so that part of the play is lost. Hence, only extremely small deviations are possible between the coupling elements. However, such apparatus is not suitable for use where there are present larger lateral deviations, such as for instance can occur with inclined elevators. Additionally, in this field of application the entrainment parallelogram in its uncoupled state, must be drawn considerably upwardly, in order to be able to move past both of the rolls when travelling past a stop location. This requires, on the one hand, a considerable amount of space and, on the other hand, leads to different lengths of coupling paths, depending upon the momentary inclination angle of the path of travel, so that the time for opening the door becomes relatively large.

SUMMARY OF THE INVENTION

Therefore, with the foregoing in mind it is a primary object of the present invention to provide a new and improved construction of apparatus for actuating elevator shaft or hoistway doors of an elevator system, which does not possess the aforementioned drawbacks and which is especially suitable for use with inclined elevators.

Still a further significant object of the present invention aims at the provision of a new and improved construction of apparatus for actuating the hoistway doors of an elevator, which is relatively simple in construction and design, extremely reliable in operation, not readily subject to breakdown or malfunction, and requires a minimum of maintenance and servicing.

Now in order to implement these and still further objects of the invention, which will become more readily apparent as the description proceeds, the hoistway door actuation apparatus of the present development is manifested by the features that the movable coupling element arranged at the elevator cabin door comprises an entrainment member composed of discs arranged at essentially the same spacing from one another. The fixed or stationary coupling element mounted at the hoistway door comprises a comb or equivalent element, the prongs or teeth of which have an essentially uniform spacing from one another which is dimensioned such that the discs of the entrainment member, during the coupling operation, can engage with play between the prongs or teeth of the comb.

According to a preferred exemplary embodiment of the invention the entrainment member is rotatably mounted in a pivotable fork or bifurcated member. The discs have an essentially circular shape and are fixedly connected with a cylindrical base body. The axis of rotation of the entrainment member extends parallel and the prongs or teeth of the comb member transversely with respect to the direction of opening of the door.

To facilitate the coupling action or operation, a further aspect of the invention contemplates constructing both the edges of the discs of the entrainment member and also the ends of the prongs or teeth of the comb to possess an acute angle and to step the diameter of the individual discs of the entrainment member in such a manner that they are limited by generatrixes or surface lines of a cone.

Additionally, for facilitating the coupling action it is proposed, according to a further feature of the invention, to arrange the entrainment member for movement in axial direction, and at each end thereof there is provided a respective spring or other suitable or equivalent element for retaining such entrainment member in its central or intermediate position.

According to a further preferred embodiment the entrainment member is formed of a noise dampening, wear resistant plastic formed on the basis of polyamide.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
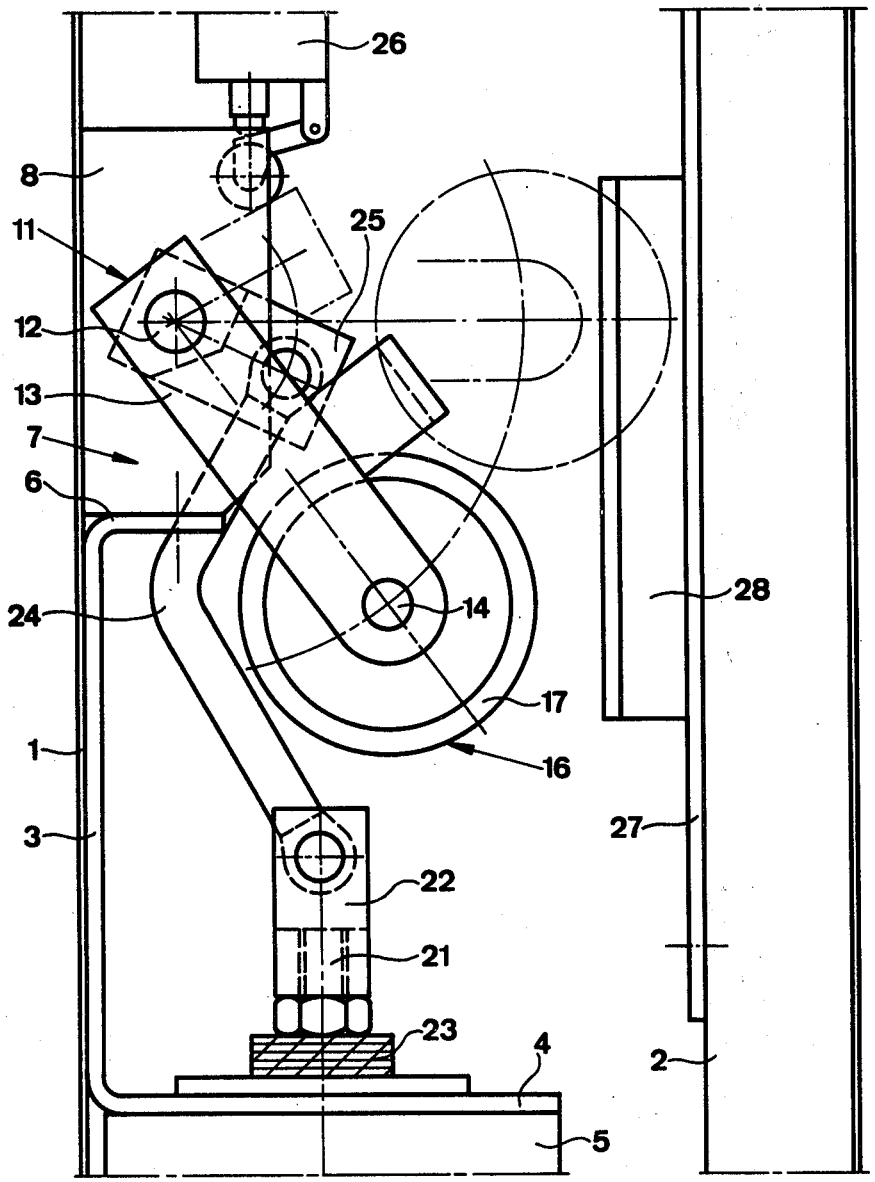
FIG. 1 is a vertical sectional view of the elevator cabin and hoistway doors of an inclined elevator equipped with an apparatus for actuating the hoistway door and shown in side view.

Describing now the drawings, it is to be understood that only enough of the elevator system has been shown in order to enable those skilled in the art to readily understand the underlying principles and concepts of the present invention. Now in FIGS. 1 and 2 reference character 1 designates an elevator cabin door and reference character 2 an elevator shaft or hoistway door of an inclined elevator or elevator system. The elevator cabin and hoistway doors 1 and 2 are horizontally displaceable sliding doors having two door wings, and which can be displaced by any suitable and therefore not further illustrated door drive arranged at the elevator cabin. Arranged at the cabin door 1 is an unequal leg U-shaped support or carrier 3. At its longer lower leg 4 there is secured, as best seen by referring to FIG. 1, a drive or drive means 5, for instance constituted by a lifting magnet or solenoid. Threaded with the shorter leg 6 of the U-shaped support or carrier 3 is a bearing arrangement 7. As best seen by referring to FIG. 2, bearing arrangement or bearing means 7 comprises a bearing housing 8 and two ball bearings 9 secured by a respective retaining or locking ring 10. Mounted at the bearing arrangement 7 is a fork or bifurcated member 11 consisting of a shaft 12 and two levers 13 rigidly connected for rotation therewith. These levers 13 are fixedly interconnected by means of a crosstie or traverse 50 extending essentially parallel to the shaft 12. An entrainment member 16 is rotatably mounted upon a bolt 14 attached to the fork or bifurcated member 11 by means of the retaining discs 15. The entrainment member 16 which preferably consists of a plastic formed on the basis of polyamide will be seen to possess a number of substantially circular discs or plates 17 arranged essentially at a uniform spacing from one another and which discs 17 are fixedly connected with a substantially cylindrical base body 18. The edges 17*a* of the discs 17 are constructed so as to have an acute angle and their diameter is stepped i.e., altered, in such a way that these discs 17 are limited or bounded by generatrixes or surface lines 19 of a cone as best seen by referring to FIG. 2. Springs 20 or other suitable or equivalent resilient elements are arranged upon the bolt 14 to both sides of the entrainment member 16. These springs 20 retain the axially displaceable entrainment member 16, in its intermediate or central position, as best seen by referring to FIG. 2.

Figure 2:
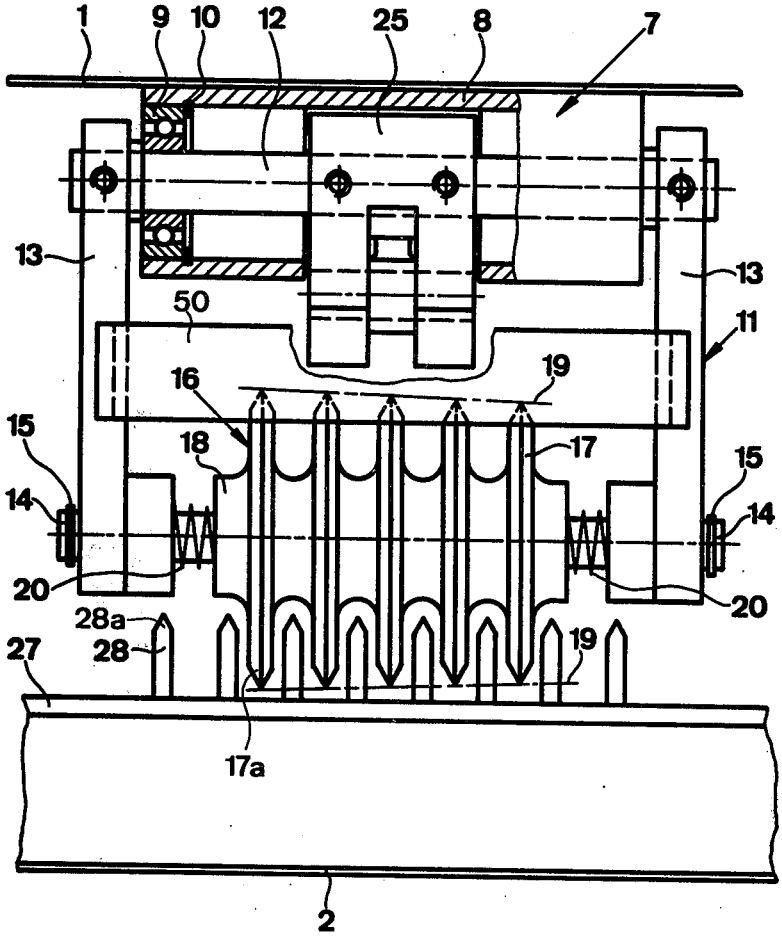
FIG. 2 is a partial sectional plan view of the arrangement shown in FIG. 1.

An actuation rod 21 of the drive or drive means 5 will be seen to have at its upper end a fork or bifurcated head 22 which, in the rest position of the drive 5, bears upon a rubber ring 23 (FIG. 1). The fork head 22 is hingedly connected with a transmission rod 24, the other end of which is articulated at a hinge or link 25 rigidly connected for rotation with the shaft 12. Reference character 26 designates a switch attached at the elevator cabin door 1, switch 26 being actuated by means of the hinge or link 25, as shown in FIG. 1.

A preferably metallic comb 27 or equivalent structure is attached at the elevator shaft or hoistway door 2. This comb 27 has prongs or teeth 28 which extend transversely with respect to the direction of opening of the door, these prongs or teeth having an essentially uniform spacing from one another and their edges 28*a* have an acute angle shape. The spacing of the prongs or teeth 28 from one another is dimensioned such that the discs 17 of the entrainment member 16, during the coupling action, engage with play between the prongs or teeth 28.

Having now had the benefit of the foregoing description of the apparatus for actuating the hoistway doors of an elevator system, the mode of operation will be considered and is as follows:

After the elevator cabin stops at a target storey or landing the lifting magnet 5 is energized and the actuation rod 21 is upwardly shifted. The transmission rod 24 and the hinge or link 25 transmit this movement to the shaft 12, so that the fork or bifurcated member 11 carries out an upward pivotal movement and the discs 17 of the entrainment member 16 come into engagement with the prongs or teeth 28 of the comb 27, whereby there is attained the phantom line position shown in FIG. 1. The hinge or link 25 now actuates the switch 26, delivering a signal to a not particularly illustrated but conventional door drive control and the door drive is placed into operation in a manner causing opening of the door. The minimum calculated play between the discs 17 and the prongs or teeth 28 ensures that there is extensively avoided any dead travel or lost motion along with the therewith associated noise. After reaching the end position the door drive is turned-off by means of a standard and thus not particularly illustrated "Door Open"-terminal switch, and the lifting magnet 5 remains in its energized condition and the discs 17 further remain in engagement with the prongs or teeth 28.

In response to an inside or external command i.e., after expiration of a predetermined amount of time the door drive assumes its door closing mode of operation. After reaching the terminal position the door drive is turned-off by means of a likewise non-illustrated "Door Close"-terminal switch, the lifting magnet 5 is deenergized and the entrainment member 16 rocks or pivots back into its uncoupled position.

The noises which are produced during energization and de-energization of the lifting magnet 5 are dampened by means of two not further illustrated hydraulic cylinders which are arranged below the lifting magnet 5 and coupled with the actuation rod 21.

The advantages which can be obtained with the present invention particularly reside in that owing to the comb-like construction of the coupling elements there is nonetheless achieved a faultless coupling action even in the presence of markedly varying lateral displacements, such as can be brought about particularly due to inaccuracies in the stopping of the elevator cabin of inclined elevators. Due to the axially displaceable resilient arrangement of the entrainment member 16 there is achieved the beneficial result that upon contact of the acute angle tips 17*a* and 28*a* of the discs 17 and the teeth 28, respectively, the entrainment member 16 can laterally deviate or shift and provide a faultless coupling action. Of particular advantage is the fact that the diameter of the discs 17 is limited or defined by cone generatrixes 19. As a result, the engagement of the individual discs 17 occurs in succession in time, so that manufacturing inaccuracies of the spacing of the discs 17 and the teeth 28, respectively, cannot lead to jamming or binding during the coupling action. A further advantage which is obtained with the invention will be recognized in terms of the rotatable arrangement of the entrainment member 16. In this way there is achieved the advantageous result that during the rocking or pivoting-in motion the entrainment member 16 rolls upon the comb 27, reducing the bearing friction and enabling the entrainment member 16 to be more easily displaceable upon the bolt 14.

As the drive or drive means 5 there also can be employed an electric motor or hydraulic or pneumatic cylinder arrangement. Also it is possible to derive the pivotal movement of the entrainment member 16 by means of a lever drive from the door drive. Furthermore, the movable coupling element 16 with the drive 5 can be arranged at the hoistway door and the fixed or stationary coupling element 27 at the elevator cabin door, so that the coupling-in movement also can be accomplished linearly.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. An apparatus for actuating the hoistway doors of an elevator system having an elevator cabin door, comprising:

a fixed coupling element arranged on one of the doors;

said coupling element comprising a comb having acute-angle teeth;

a movable electromagnetically actuatable coupling element arranged on the other of said doors;

a pivotable fork member;

means for pivotably mounting said fork member;

said movable electromagnetically actuatable coupling element comprising an entrainment member;

said movable electromagnetically actuatable coupling element being engageable with the coupling element at the region of an elevator landing;

said entrainment member comprising a number of disks rotatably mounted on said pivotable fork member, said disks having different diameters and being arranged essentially at the same spacing from one another;

the respective diameter of the individual disks of the entrainment member being altered in such a fashion that the extremities of said disks are limited by cone generatrixes; and said disks having edges of essentially acute angle configuration.

2. The apparatus as defined in claim 1, further including:

means for rotatably mounting said entrainment member in said pivotable fork member;

said rotatably mounting means for said entrainment member includes means for enabling movement of said entrainment member in axial direction;

said entrainment member having opposed ends;

a resilient member provided at each end of the entrainment member for retaining said entrainment member in an intermediate position.

3. The apparatus as defined in claim 2, wherein:

each said resilient member comprises a spring.

4. An apparatus for actuating the hoistway doors of an elevator system having an elevator cabin door, comprising:

a fixed coupling element arranged on a hoistway door;

a movable, electromagnetically actuatable coupling element arranged on the elevator cabin door;

said movable coupling element being engageable with the fixed coupling element of the hoistway door at the region of an elevator landing;

said movable coupling element comprising an entrainment member composed of disks arranged essentially at a uniform spacing from one another;

said fixed coupling element comprising a comb having spaced teeth;

said comb teeth having an essentially uniform spacing from one another which is dimensioned such that during coupling of the entrainment member with the comb the disks of the entrainment member can engage with play between the teeth of the comb;

a pivotable fork member;

means for pivotably mounting said fork member;

means for rotatably mounting said entrainment member in said pivotable fork member;

said disks having a substantially circular configuration;

a substantially cylindrical base body with which there are rigidly connected said circular disks;

said entrainment member having an axis of rotation;

said axis of rotation of said entrainment member extending essentially parallel and said teeth of said comb essentially transversely with respect to the door opening direction; and the respective diameter of the individual disks of the entrainment member being stepped in such a fashion that the extremities of said disks are limited by cone generatrixes.

5. An apparatus for actuating the hoistway doors of an elevator system having an elevator cabin door, comprising:

a fixed coupling element arranged on a hoistway door;

a movable, electromagnetically actuatable coupling element arranged on the elevator cabin door;

said movable coupling element being engageable with the fixed coupling element of the hoistway door at the region of an elevator landing;

said movable coupling element comprising an entrainment member composed of disks arranged essentially at a uniform spacing from one another;

said fixed coupling element comprising a comb having spaced teeth;

said comb teeth having an essentially uniform spacing from one another which is dimensioned such that during coupling of the entrainment member with the comb the disks of the entrainment member can engage with play between the teeth of the comb;

a pivotable fork member;

means for pivotably mounting said fork member;

means for rotatably mounting said entrainment member in said pivotable fork member;

said disks having a substantially circular configuration;

a substantially cylindrical base body with which there are rigidly connected said circular disks;

said entrainment member having an axis of rotation;

said axis of rotation of said entrainment member extending essentially parallel and said teeth of said comb essentially transversely with respect to the door opening direction;

said rotatably mounting means for said entrainment member includes means for enabling movement of said entrainment member in axial direction;

said entrainment member having opposed ends; and a resilient member provided at each end of the entrainment member for retaining said entrainment member in an intermediate position.

6. The apparatus as defined in claim 5, wherein:

each said resilient member comprises a spring.

7. The apparatus as defined in claim 5, wherein:

said entrainment member is formed of a sound dampening, wear resistent plastic formed on the basis of polyamide.

* * * * *